US011346368B1

(12) United States Patent
Sun et al.

(10) Patent No.: US 11,346,368 B1
(45) Date of Patent: May 31, 2022

(54) ELECTRICAL MULTI-PURPOSE APPARATUS

(71) Applicants: Hsi-Yung Sun, Taichung (TW); Antonio La Petina, Jr., Boise, ID (US)

(72) Inventors: Hsi-Yung Sun, Taichung (TW); Antonio La Petina, Jr., Boise, ID (US)

( * ) Notice: Subject to any disclaimer, the term of this patent is extended or adjusted under 35 U.S.C. 154(b) by 0 days.

(21) Appl. No.: 17/215,149

(22) Filed: Mar. 29, 2021

(51) Int. Cl.
*F04D 29/56* (2006.01)
*F04D 29/40* (2006.01)

(52) U.S. Cl.
CPC ..... *F04D 29/563* (2013.01); *F04D 29/403* (2013.01)

(58) Field of Classification Search
CPC ..... F04D 29/563; F04D 29/403
See application file for complete search history.

(56) References Cited

U.S. PATENT DOCUMENTS

2006/0067839 A1* 3/2006 Nakken ..... F04B 39/066 417/366
2009/0093330 A1* 4/2009 Kumazaki ..... B60K 6/445 475/5
2010/0078238 A1* 4/2010 Oba ..... B60W 30/19 180/65.225
2013/0143706 A1* 6/2013 Holmes ..... B60K 6/52 475/5
2018/0298994 A1* 10/2018 Lian ..... B60K 1/02

FOREIGN PATENT DOCUMENTS

CN 204045202 U * 12/2014
CN 205478332 U * 8/2016
CN 210434990 U * 5/2020
CN 105780702 A * 7/2020

* cited by examiner

*Primary Examiner* — Joseph J Dallo
(74) *Attorney, Agent, or Firm* — Rosenberg, Klein & Lee

(57) ABSTRACT

An electrical multi-purpose apparatus includes a base frame unit, and an internal combustion engine, an electric generator, an output unit, an air compressor, and a jet cleaner that are disposed on the base frame unit. The internal combustion engine includes a combustion engine motor. The electric generator is driven operably by the internal combustion engine for generating electric power. The output unit, the air compressor, and the jet cleaner are electrically connected to the electric generator. The air compressor includes an air compressor motor. The jet leaner includes a jet cleaner motor. The combustion engine motor, the air compressor motor, and the jet cleaner motor have different motor speeds.

9 Claims, 6 Drawing Sheets

ELECTRICAL MULTI-PURPOSE APPARATUS

FIELD

The disclosure relates to a household electrical apparatus, more particularly to an electrical multi-purpose apparatus.

BACKGROUND

With the advancement of technology and the DIY atmosphere becoming more common, the market for household electrical appliances such as household air compressors and household jet cleaners has developed. However, an average family generally lacks ample storage space if it simultaneously owns multiple electrical appliances. The industry tried to integrate a multiplicity of electric appliances in one compact housing to reduce the consumer product's size; however, if the closely-arranged pieces of rotating machinery of the electric appliances rotate at a similar speed, excessive vibration may occur due to resonance of the housing structure on which they are mounted, which leads to unstable operation of the integrated appliance.

SUMMARY

Therefore, the object of the disclosure is to provide an electrical multi-purpose apparatus that can alleviate the drawback associated with the abovementioned prior art.

According to the disclosure, an electrical multi-purpose apparatus includes a base frame unit, an internal combustion engine, an electric generator, an output unit, an air compressor, and a jet cleaner. The internal combustion engine is disposed on the base frame unit, and includes a combustion engine motor that has a rotatable output shaft. The electric generator is disposed on the base frame unit, is connected to the internal combustion engine, and is driven operably by the output shaft for generating electric power. The output unit is disposed on the base frame unit, and has at least one power output module that is electrically connected to the electric generator for providing at least one power output. The air compressor is disposed on the base frame unit, electrically connected to the electric generator, and includes an air compressor motor that is powered by the electric power. The jet leaner is disposed on the base frame unit, is electrically connected to the electric generator, and includes a jet cleaner motor that is powered by the electric power. The combustion engine motor of the internal combustion engine, the air compressor motor of the air compressor, and the jet cleaner motor of the jet cleaner have different motor speeds.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
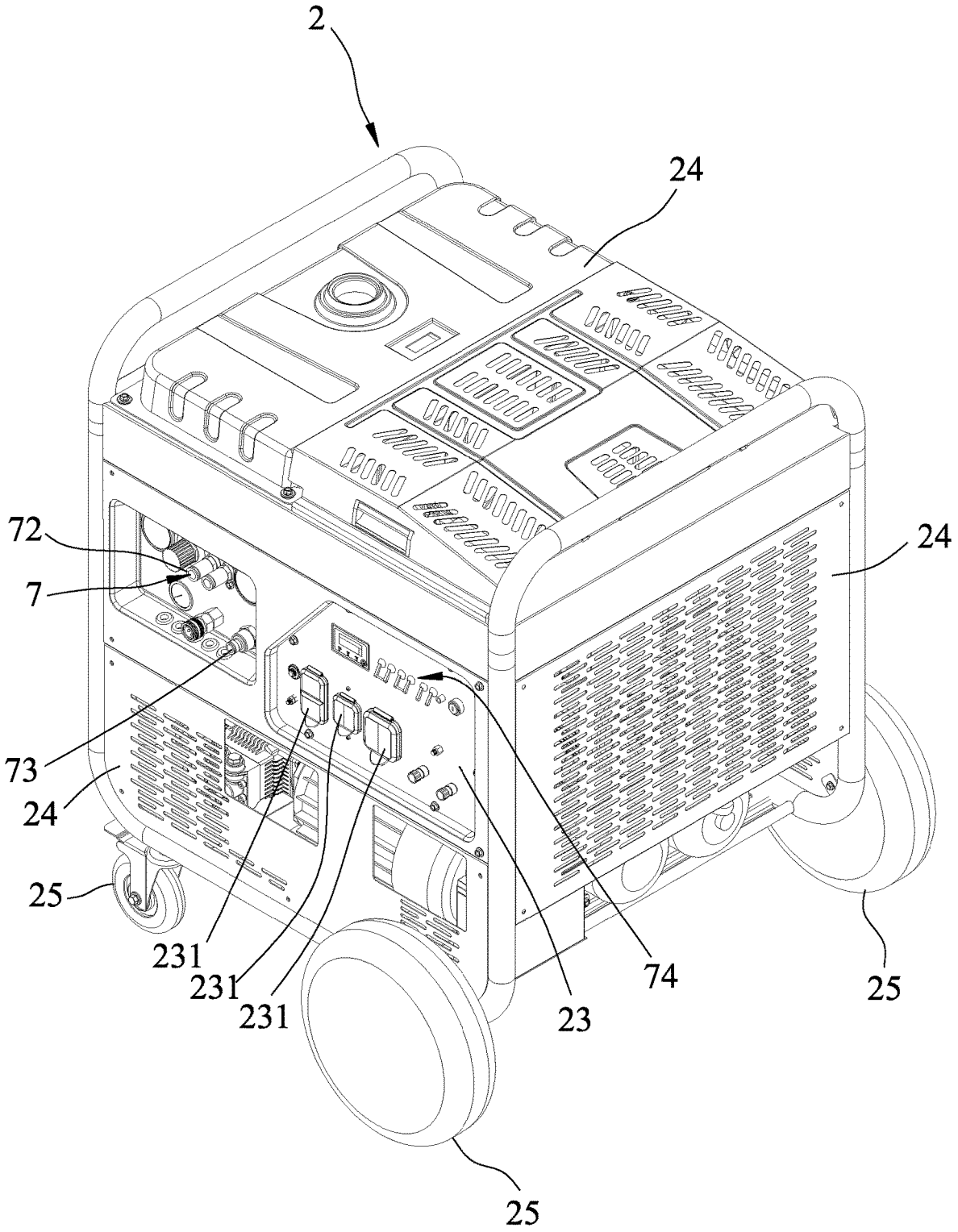
FIG. 1 is an assembled perspective view of an embodiment of an electrical multi-purpose apparatus according to the disclosure.

As shown in FIGS. 1 to 3 and 6, an embodiment of the electrical multi-purpose apparatus of the present disclosure includes a base frame unit 2, an internal combustion engine 3, an electric generator 4, an air compressor 5, a jet cleaner 6, an output unit 7, a protection unit 8, and a plurality of shockproof pads 91.

The base frame unit 2 includes a frame 21, a hanger 22 connected to and located inside an upper portion of the frame 21, a waterproof box 23 disposed on the frame 21 and having a plurality of waterproof covers 231, a plurality of housing plates 24 connected to the frame 21 for covering the installations inside the frame 21, and a plurality of wheels 25 connected to a lower end of the frame 21. The overall length, width, and height of the base frame unit 2 are each less than 1 meter in this embodiment, such that it can be easily moved and stored, and is therefore suitable for household use.

Figure 2:
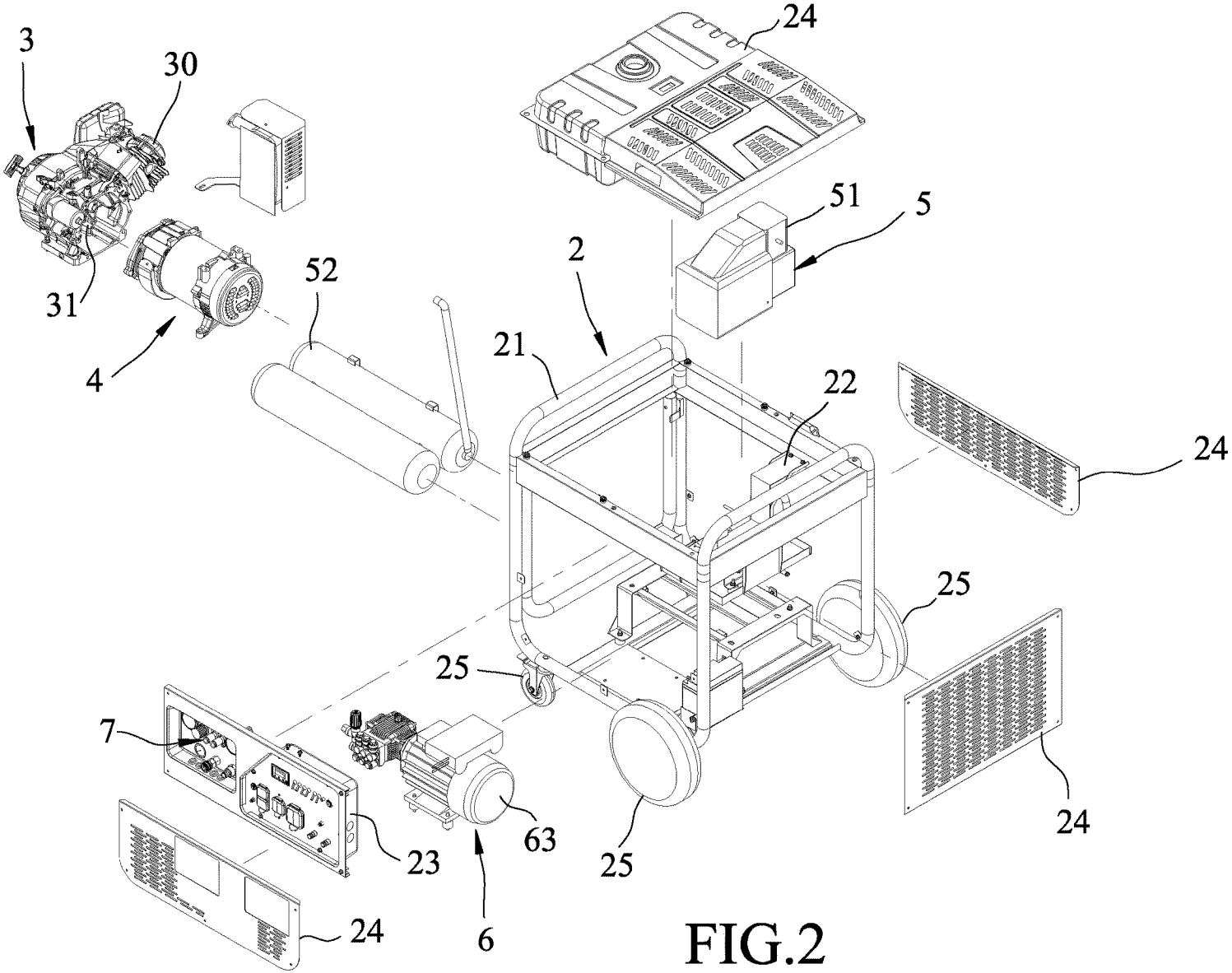
FIG. 2 is an exploded perspective view of the embodiment.
Figure 3:
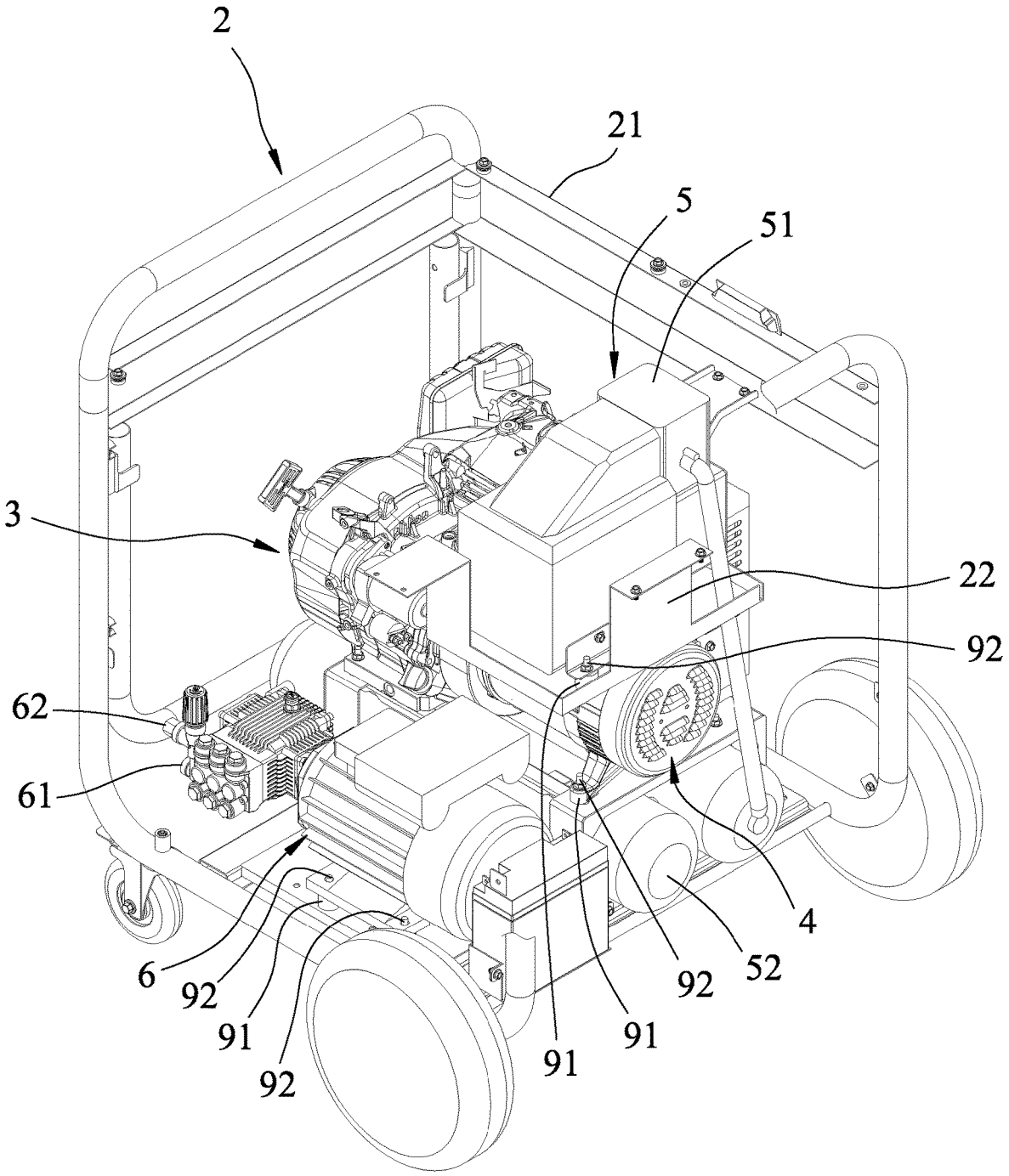
FIG. 3 is a fragmentary perspective view of this embodiment.
Figure 4:
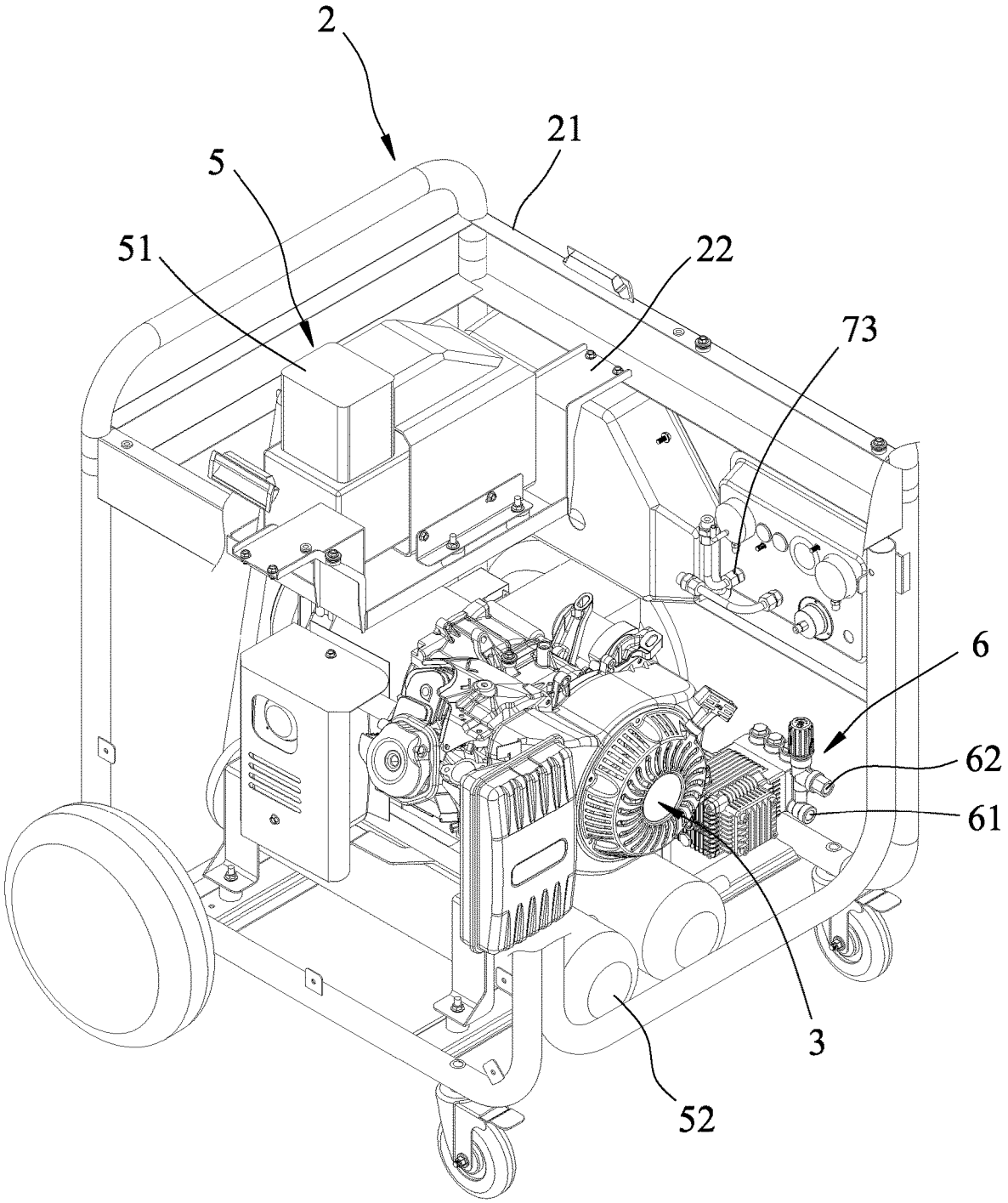
FIG. 4 is a fragmentary perspective view of this embodiment at a different viewing angle from that of FIG. 3.

Referring to FIGS. 2, 3, and 4, the internal combustion engine 3 is disposed on the frame 21 and includes a combustion engine motor 30 having an output shaft 31. The internal combustion engine 3 may be a small engine such as a gasoline engine of Jiangdong 15 HP or a gasoline engine of Honda GX390 to meet household appliance size needs.

The electric generator 4 is disposed on the frame 21, is connected directly to the output shaft 31 of the internal combustion engine 3, and is driven operably by the output shaft 31 for generating electric power. The electrical generator 4 may be a generator with a rated output power of 7 KW. The output AC single-phase power supply 240V can charge electronic devices below 6.5 KW and 12V DC equipments and meet household appliance size needs.

The air compressor 5 includes an air compressor motor 51 and an air tank group 52. The air compressor motor 51 is mounted on the hanger 22 and positioned above the internal combustion engine 3 and the electric generator 4 by way of the hanger 22; the air tank group 52 is disposed beside the jet cleaner 6 and below the internal combustion engine 3 and the electric generator 4. The air compressor motor 51 is electrically connected to the electric generator 4, and is powered by the electric power from the electric generator 4 for providing high-pressure air. The air compressor motor 51 may be a 1.5 KW piston air compressor, with a maximum working pressure of 8 BAR and a maximum flow of 267 L/min. It can be used to power various pneumatic tools such as nail guns, spray guns, air blowguns, and pneumatic wrenches and meet household size needs.

The jet cleaner 6 is disposed on the frame 21 and disposed below the internal combustion engine 3 and electric generator 4 to a side of the internal combustion engine 3 and electric generator 4. The jet cleaner 6 is electrically connected to the electric generator 4, and includes a jet cleaner motor 63 that is powered by the electric power from the electric generator 4. In this embodiment, the jet cleaner 6 has a water inlet 61 that is disposed at a bottom portion of the base frame unit 2, and a water outlet 62 that is connected with the output unit 7 with a high-pressure pipe, such that operation of the electrical multi-purpose apparatus would not be affected in case of water leakage from the jet cleaner 6. The internal combustion engine 3, the electric generator 4, and the air compressor 5 may be configured with a protection level of IP54 or higher to improve the whole apparatus's waterproof performance.

The combustion engine motor 30 of the internal combustion engine 3, the air compressor motor 51 of the air compressor 5, and the jet cleaner motor 63 of the jet cleaner 6 are configured to have different motor speeds. In this embodiment, the motor speeds of the combustion engine motor 30, the jet cleaner motor 63 and the air compressor motor 51 are set to be ($\omega+\Delta\omega 1$), $\omega$, ($\omega-\Delta\omega 2$), in which $\omega$ is a preset motor speed, and $\Delta\omega 1$ and $\Delta\omega 2$ are values that range between 4% and 6% of co. For example, the motor speeds of the combustion engine motor 30, the jet cleaner motor 63 and the air compressor motor 51 may be 3650 rpm, 3500 rpm, and 3350 rpm, respectively.

The consideration of differentiation of the abovementioned motor speeds is that, for example, if the air compressor motor 51 and the jet cleaner motor 63 are both 60 Hz, and the usual rotating speeds thereof are 3600 rpm, in case that the rotating speed of the combustion engine motor 30 is also 3600 rpm, excessive vibration due to structural resonance may occur. Therefore, the operations become unstable when the three are operating simultaneously. By differentiating their running speeds through the above setting, the excessive vibration due to structural resonance can be virtually reduced.

Figure 5:
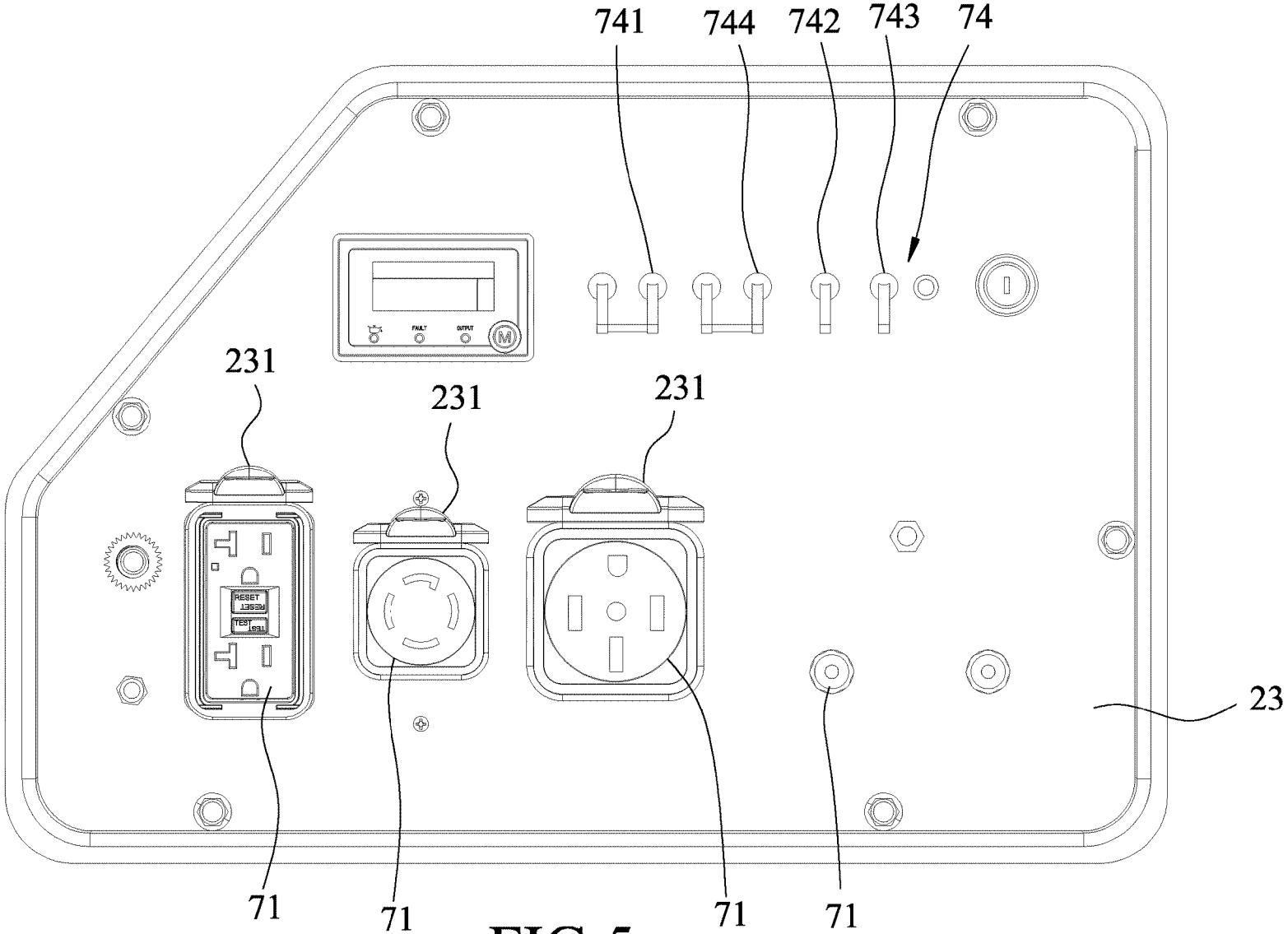
FIG. 5 is a side view illustrating an output unit of the embodiment.
Figure 6:
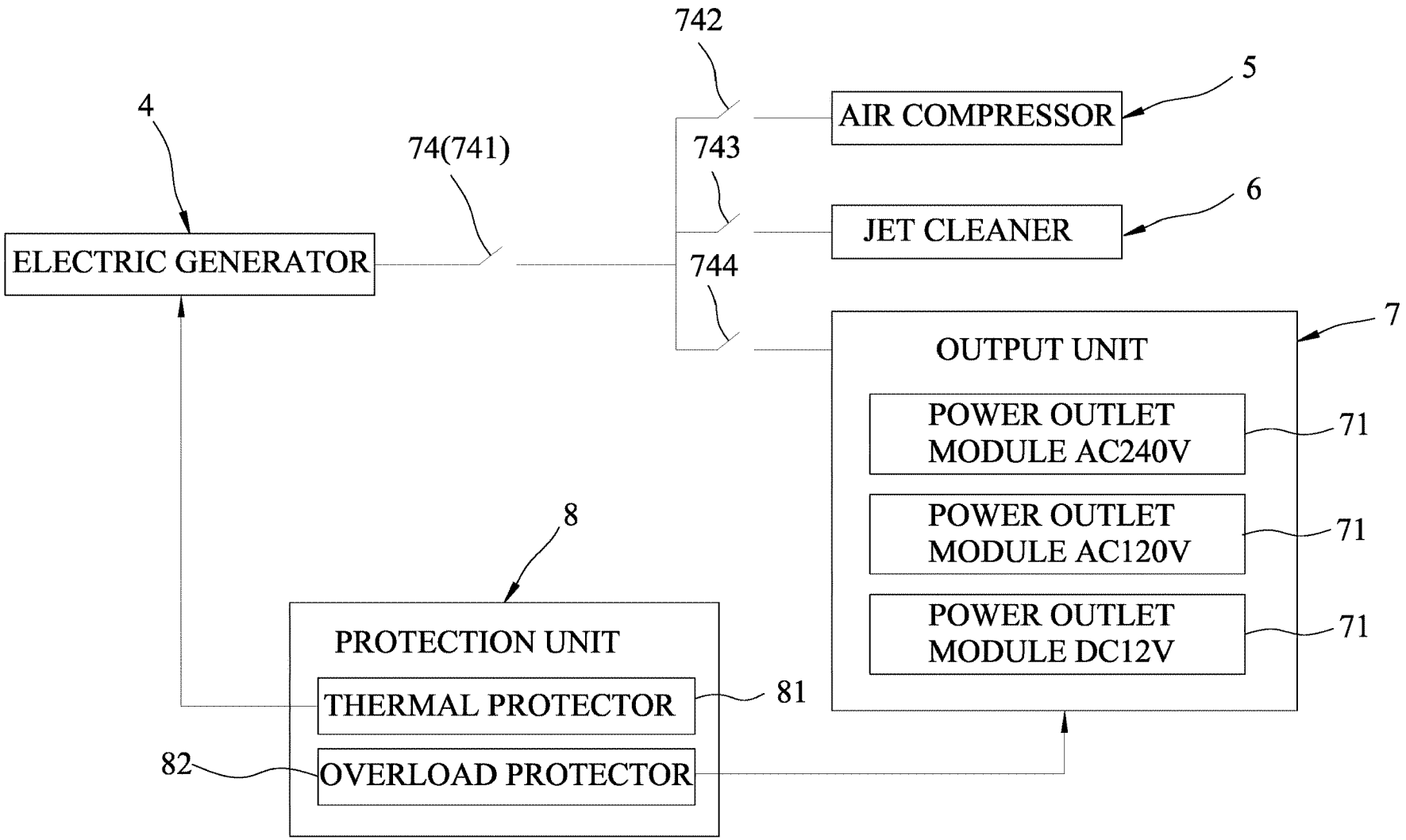
FIG. 6 is a schematic circuit block diagram of this embodiment.

Referring to FIGS. 1, 5 and 6, in this embodiment, the output unit 7 is disposed on the base frame unit 2. The output unit 7 has a plurality of power outlet modules 71 electrically connected to the electric generator 4, a pneumatic output connector 72, a water jet output connector 73, and a switch module 74. Alternatively, the output unit 7 can include only a single power outlet module 71, depending on requirements.

The power outlet modules 71 are located in the waterproof box 23 and are waterproofed through being covered by the corresponding waterproof covers 231 that can be opened when needed. The power outlet modules 71 preferably include different forms of power outlets that provide AC and DC output; for example, the output of the power outlet modules 71 can consist of AC 240V, AC 120V, and DC 12V, and power outlet specifications may be typical electrical specifications such as GFC1, L14-30, 14-50R, etc.

The pneumatic output connector 72 is connected to the air compressor 5 for outputting high-pressure air which is provided by the air compressor 5 and which is to be used by external pneumatic tools.

The water jet output connector 73 is connected to the water outlet 62 of the jet cleaner 6 (see FIG. 4) to output high-pressure water which is provided by the jet cleaner 6 and which is to be use by an external high-pressure cleaning gun. The water jet output connector 73 may be implemented by a quick connector that can be easily connected to the external high-pressure cleaning gun and that can effectively alleviate leakage therebetween.

The switch module 74 includes a main switch 741, an air compressor switch 742, a jet cleaner switch 743, and a power output switch 744. The main switch 741 is used as the master switch of the electric power supplied by the electric generator 4, and the air compressor switch 742, the jet cleaner switch 743, and the power output switch 744 are the power switches of the air compressor 5, the jet cleaner 6, and the power outlet modules 71, respectively.

The protection unit 8 includes a thermal protector 81 provided to the electric generator 4, and an overload protector 82 electrically connected to the power outlet modules 71.

The thermal protector 81 is operable for stopping the electric generator operation 4 when the temperature of the electric generator 4 is greater than a predetermined temperature threshold. The thermal protector 81 can be implemented by a thermistor with an electronic circuit or implemented by a commercially available temperature control switch thermal protector.

The overload protector 82 is operable for interrupting a flow of current path of the power outlet module 71 if the flow of current of the power outlet modules 71 is greater than a predetermined current threshold. The overload protector 82 can be implemented by fuses connected in series between the electric generator 4 and the power outlet modules 71 or implemented by a commercially available overload protection circuit breaker. Since the implementations of the thermal protector 81 and the overload protector 82 is known in the art, further details will not be described hereinafter for the sake of brevity.

The shockproof pads 91 are disposed between the internal combustion engine 3, the electric generator 4, the air compressor 5, the jet cleaner 6, and the base frame unit 2 to attenuate resonance and dampen the vibration at resonance. In other words, each of the internal combustion engine 3, the electric generator 4, the air compressor 5, and the jet cleaner 6 is disposed on the base frame unit 2 with corresponding one(s) of the shockproof pads 91 interposed therebetween. Preferably, the shockproof pads 91 are respectively disposed to a plurality of mounting holes (not shown) of the base frame unit 2, and the internal combustion engine 3, the electric generator 4, the air compressor 5, and the jet cleaner 6 are fixed to the base frame unit 2 by a plurality of screws 92 respectively passing through the shockproof pads 91 and the mounting holes.

Based on the above description, the advantages of this embodiment are as follows:

First, by integrating the internal combustion engine 3, the electric generator 4, the air compressor 5, and the jet cleaner 6 into the base frame unit 2, a household electrical multipurpose apparatus can be provided. The overall length, width, and height of the base frame unit 2 are each less than 1 meter, such that is can be easily moved and stored. Moreover, by setting the motor speeds of the combustion engine motor 30, the air compressor motor 51, and the jet cleaner motor 63 to be different, excessive vibration due to structural resonance can be prevented. Therefore, both the household use size needs and the operation stability can be taken into account.

Second, by setting the motor speeds of the combustion engine motor 30, the jet cleaner motor 63 and the air compressor motor 51 to be ($\omega+\Delta\omega 1$), $\omega$, ($\omega-\Delta\omega 2$), respectively, with $\Delta\omega 1$ and $\Delta\omega 2$ being values that range between 4% to 6% of $\omega$, excessive vibration due to structural resonance can be prevented, while the motor speeds of the combustion engine motor 30, the air compressor motor 51, and the jet cleaner motor 63 are still in the proper rotation speed range so that typical operating performance can be maintained.

Third, by disposing the shockproof pads 91 between the base frame unit 2 and the internal combustion engine 3, the electric generator 4, the air compressor 5, and the jet cleaner 6, it can improve further the attenuation of structural resonance.

Fourth, by arranging the jet cleaner 6 below the internal combustion engine 3 and the electric generator 4, and placing the air compressor motor 51 above the internal combustion engine 3 and the electric generator 4 by the hanger 22, meanwhile, by disposing the power outlet modules 71, the pneumatic output connector 72, and the water jet output connector 73 on the outside of the base frame unit 2 instead of providing directly thereon, the size of this embodiment can be further reduced, which makes this embodiment more apt for household use.

Fifth, by providing the thermal protector 81 and the overload protector 82, the power can be automatically cut off when overloaded to avoid damage to the electrical apparatus, thereby improving safety of use.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electrical multi-purpose apparatus comprising:

a base frame unit;

an internal combustion engine disposed on said base frame unit, and including a rotatable output shaft;

an electric generator disposed on said base frame unit, said electric generator being connected to said internal combustion engine and driven operably by said output shaft for generating electric power;

an output unit disposed on said base frame unit and having at least one power outlet module that is electrically connected to said electric generator for providing at least one power output;

an air compressor disposed on said base frame unit and being electrically connected to said electric generator, said air compressor including an air compressor motor powered by said electric power; and a jet cleaner disposed on said base frame unit and being electrically connected to said electric generator, said jet cleaner including a jet cleaner motor powered by said electric power;

wherein said rotatable output shaft of said internal combustion engine, said air compressor motor of said air compressor, and said jet cleaner motor of said jet cleaner each have different rotational speeds.

2. The electrical multi-purpose apparatus as claimed in claim 1, wherein said rotational speeds of said internal combustion engine, said jet cleaner motor, and said air compressor motor are respectively $(\omega+\Delta\omega\mathbf{1})$, $\omega$, $(\omega-\Delta\omega\mathbf{2})$, $\omega$ being a preset motor speed, said $\Delta\omega\mathbf{1}$ and $\alpha\omega\mathbf{2}$ having values that range between 4% and 6% of $\omega$.

3. The electrical multi-purpose apparatus as claimed in claim 1, further comprising a plurality of shockproof pads, each of said internal combustion engine, said electric generator, said air compressor, and said jet cleaner being disposed on said base frame unit with a corresponding portion of said plurality of shockproof pads interposed therebetween.

4. The electrical multi-purpose apparatus as claimed in claim 1, wherein said base frame unit includes a frame and a hanger connected to and located inside of said frame, said internal combustion engine, said electric generator and said jet cleaner being mounted on said frame, said air compressor being mounted on said hanger.

5. The electrical multi-purpose apparatus as claimed in claim 4, wherein said jet cleaner is disposed below said internal combustion engine and said electric generator, and at least a portion of said air compressor is disposed above said internal combustion engine and said electric generator.

6. The electrical multi-purpose apparatus as claimed in claim 4, wherein said base frame unit further includes a waterproof box disposed on said frame, said at least one power outlet module being located in said waterproof box.

7. The electrical multi-purpose apparatus as claimed in claim 1, wherein said output unit further has a pneumatic output connector connected to said air compressor, and a water jet output connector connected to said jet cleaner.

8. The electrical multi-purpose apparatus as claimed in claim 1, further comprising a protection unit which includes a thermal protector provided to said electric generator, and an overload protector electrically connected to said at least one power outlet module, said thermal protector being operable for stopping said electric generator if a temperature of said electric generator is greater than a predetermined temperature threshold, said overload protector being operable for interrupting a flow of current in said at least one power outlet module if the flow of current of said at least one power outlet module is greater than a predetermined current threshold.

9. The electrical multi-purpose apparatus as claimed in claim 1, wherein said at least one power outlet module includes a plurality of power outlet modules with different forms for AC and DC outputs, respectively.

* * * * *